US007171888B2

(12) United States Patent
Boecker

(10) Patent No.: US 7,171,888 B2
(45) Date of Patent: Feb. 6, 2007

(54) HYDRAULIC CYLINDER

(75) Inventor: Martin Boecker, Korschenbroich (DE)

(73) Assignee: TRW Automotive GmbH (DE)

( * ) Notice: Subject to any disclaimer, the term of this patent is extended or adjusted under 35 U.S.C. 154(b) by 0 days.

(21) Appl. No.: 11/148,514

(22) Filed: Jun. 9, 2005

(65) Prior Publication Data

US 2005/0226750 A1 Oct. 13, 2005

Related U.S. Application Data

(63) Continuation of application No. PCT/EP2003/014084, filed on Dec. 11, 2003.

(30) Foreign Application Priority Data

Dec. 13, 2002 (DE) ..... 202 19 451

(51) Int. Cl.
*F15B 15/22* (2006.01)

(52) U.S. Cl. ..... 91/394; 91/395; 91/408; 91/409; 92/181; 92/183

(58) Field of Classification Search ..... 92/163, 92/169.1, 181 R, 183; 91/394, 395, 405, 91/408, 409

See application file for complete search history.

(56) References Cited

U.S. PATENT DOCUMENTS

| | | | | |
|---|---|---|---|---|
| 2,642,845 A | | 6/1953 | Stevens | |
| 3,296,942 A | | 1/1967 | Nelson | |
| 3,323,422 A | | 6/1967 | Freese | |
| 3,440,930 A | * | 4/1969 | Olson | 91/396 |
| 3,677,141 A | * | 7/1972 | Lagerqvist et al. | 91/394 |
| 3,802,319 A | | 4/1974 | Bridwell et al. | |
| 3,999,463 A | * | 12/1976 | Greenwood | 91/395 |
| 4,296,675 A | * | 10/1981 | Gies | 91/396 |
| 4,862,786 A | * | 9/1989 | Boyer et al. | 91/26 |
| 6,382,074 B1 | * | 5/2002 | Migliori | 91/395 |
| 6,553,889 B2 | * | 4/2003 | Migliori | 91/394 |

FOREIGN PATENT DOCUMENTS

| | | |
|---|---|---|
| DE | 1014847 | 8/1957 |
| DE | 3920293 C2 | 1/1991 |
| DE | 29706364 U1 | 6/1997 |
| DE | 19843154 A1 | 4/1999 |

(Continued)

OTHER PUBLICATIONS

International Search Report, PCT/EP03/14084.

(Continued)

*Primary Examiner*—Igor Kershteyn
(74) *Attorney, Agent, or Firm*—MacMillan, Sobanski & Todd, LLC

(57) ABSTRACT

A hydraulic cylinder comprising a cylinder, a piston which is adjustable in the cylinder, and at least one pressure connection which is disposed in the vicinity of an end position of the piston and through which a pressure fluid can be introduced into the cylinder, is characterized in that the piston is provided with a valve element which can cooperate with the pressure connection, in order to cover the pressure connection when the piston approaches its end position, and in order to uncover the pressure connection when pressure fluid is introduced into the cylinder.

8 Claims, 3 Drawing Sheets

FOREIGN PATENT DOCUMENTS

EP 1031697 A1 8/2000

OTHER PUBLICATIONS

English Language Abstract of EP1031697 from esp@cenet database.

English Language Abstract of DE 1 014 847.

German Patent and Trademark Office Search Report. DE 202 19 451.5.

English Language Abstract of DE 3920293 from esp@cenet database.

* cited by examiner

HYDRAULIC CYLINDER

CROSS REFERENCE TO RELATED APPLICATIONS

This application is a continuation of International Application No. PCT/EP2003/014084 filed Dec. 11, 2003, the disclosures of which are incorporated herein by reference, and which claimed priority to German Patent Application No. 202 19 451.5 filed Dec. 13, 2002, the disclosures of which are incorporated herein by reference.

BACKGROUND OF THE INVENTION

This invention relates to a hydraulic cylinder comprising a cylinder, a piston which is adjustable in the cylinder, and at least one pressure connection which is disposed in the vicinity of an end position of the piston and by means of which a pressure fluid can be introduced into the cylinder.

To minimize the inertia forces and noises during retraction of the piston of the hydraulic cylinder to its end position, there is usually employed a hydraulic end position damping. The flow cross-section of the pressure fluid displaced is closed in in dependence on the path shortly before reaching the limit stop, so that a rather constant deceleration of the piston is achieved by increasing the flow cross-section. To provide for a rather quick, undamped extension of the piston in the opposite direction, a check valve is usually provided, by means of which the incoming pressure fluid can evade the increased flow resistance.

What is disadvantageous in the known end position dampings is the fact that there are always required additional, moving components. Moreover, due to the available small space within the cylinder it is very difficult to accommodate a reliably operating end position damping.

BRIEF SUMMARY OF THE INVENTION

An object of the invention consists in creating an inexpensive end position damping which can do without any additional moving parts.

In a hydraulic cylinder as mentioned above, it is therefore provided in accordance with the invention that the piston is provided with a valve element which can cooperate with the pressure connection, in order to cover the pressure connection when the piston approaches its end position, and to uncover the pressure connection when pressure fluid is introduced into the cylinder. The invention is based on the fundamental idea to provide the already known check valves not as separate components in the cylinder, but integrate the same in the piston such that a reduction of the building expenses is obtained.

In accordance with a preferred embodiment of the invention it is provided that the valve element is formed by an elastically deformable part of the piston, in particular by an apron of a pot-shaped end portion of the piston. When the piston approaches its end position, the hydraulic pressure then acting on the front side of the piston urges the apron to the outside against the cylinder wall, so that the apron will seal there and close the pressure connection. In this way, the desired high flow resistance is obtained. On the other hand, when pressure fluid is introduced into the cylinder space via the pressure connection, the apron is elastically adjusted to the inside by the pressure fluid, so that there is obtained the desired large flow cross-section with a correspondingly low flow resistance. Thus, the piston can be moved out of its end position without any deceleration.

The end portion of the piston provided with the apron can be formed integrally with the same. In accordance with a preferred embodiment of the invention it is also possible to construct the piston in a multipart design and provide a pot-like end piece which is provided with the apron. In any case, there is obtained a reduction of the number of required components, as a separate check valve is no longer necessary.

Other advantages of this invention will become apparent to those skilled in the art from the following detailed description of the preferred embodiment, when read in light of the accompanying drawings.

BRIEF DESCRIPTION OF THE DRAWINGS

The invention will subsequently be described with reference to a preferred embodiment which is represented in the attached drawings, in which.

DETAILED DESCRIPTION OF THE INVENTION

Figure 1:
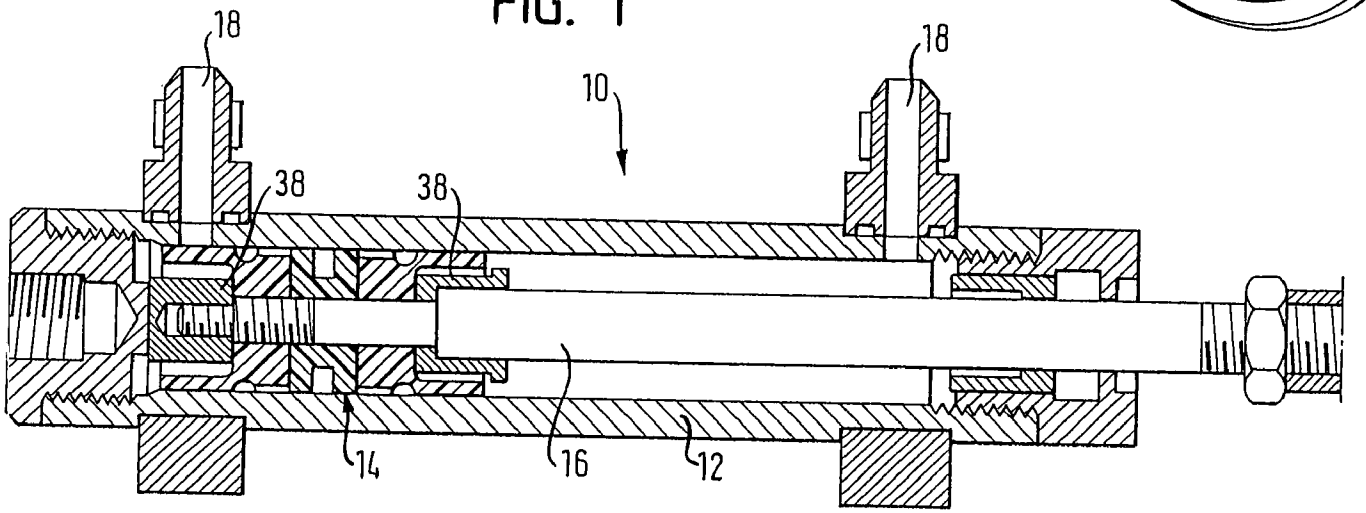
FIG. 1 shows a hydraulic cylinder in accordance with the invention in a sectional view.

FIG. 1 shows a hydraulic cylinder 10, which has a cylinder 12 and a piston 14 which is adjustable therein. The piston 14 is connected with a piston rod 16, which at the right end of the cylinder 12 with respect to FIG. 1 extends out of the same and can for instance be connected with a steering linkage. The cylinder 12 is provided with two pressure connections 18, through which a pressure fluid can be introduced into the cylinder 12. In this way, the piston 14 can be adjusted between its left end position shown in FIG. 1 and a right end position, in which it is located at the right end of the cylinder 12 with respect to FIG. 1.

The piston 14 consists of a middle piece 20 (see also FIG. 3) and two end pieces 22. The middle piece 20 and the two end pieces 22 are screwed into the piston rod 16. The two end pieces 22 and also the middle piece are preferably made of plastics, for instance PA66 or POM. In the middle piece, a piston ring 24 is provided, which is radially urged to the outside against the cylinder 12 by an O-ring 26, and seals there.

Each end piece 22 has a pot-shaped design and has an apron 28, which surrounds a cavity 30. Due to the appropriate choice of the material of the end piece 22 and the wall thickness of the apron 28, the same is elastically deformable, so that it can partially be deformed from its starting condition shown for instance in FIG. 3, in which the apron extends parallel to the wall of the cylinder 12, into the shape 28' shown in FIG. 2 in broken lines, in which it is partially deformed away from the cylinder wall, i.e. radially inwards.

In the vicinity of the transition between the apron 28 and the body of the end piece 22 an annular groove 32 is provided, which by means of a passage 34 is connected with the cavity 30 surrounded by the apron 28. The radius of the annular groove 32 also influences the deformability of the apron 28.

In accordance with a simpler variant it is also possible to omit the passage 34.

When the piston 14 is moved from a position in the middle of the cylinder 12 into its left end position, for example, the pressure connection 18 is increasingly covered by the apron 28. As a result, the flow resistance is increased for the pressure fluid, which is compressed between the end piece 22 and an end wall 36 of the cylinder 12 and seeks to flow out of the corresponding pressure space through the pressure connection 18. Since the pressure in the pressure space is increased, the apron 28 is urged radially to the outside against the pressure connection 18, which further reduces the available flow cross-section. On the whole, the piston is uniformly decelerated.

When the piston should be moved out of its end position, pressure fluid is supplied via the corresponding pressure connection 18. In the region opposite the pressure connection 18, the apron 28 is thereby deformed radially to the inside (see FIG. 2), so that a large flow cross-section is available for the incoming pressure fluid.

The passage 34 ensures that the pressure between the cylinder 12 and the apron 28 does not drop too much as compared to the pressure in the cavity 30, which would lead to a strong friction or to jamming.

As can be seen in FIG. 1, a limit stop 38 is provided in the cavity 30 inside the apron 28, which limit stop can rest against the corresponding end wall 36 of the cylinder 12. This prevents the free, annular end face of the apron 28 from resting against the end wall 36 of the cylinder 12 and sealing there. This would decelerate the inflow of pressure fluid into the cavity 30 and thus the fast application of the complete pressure of the pressure fluid to the piston and would damage the comparatively soft apron.

Figure 4:
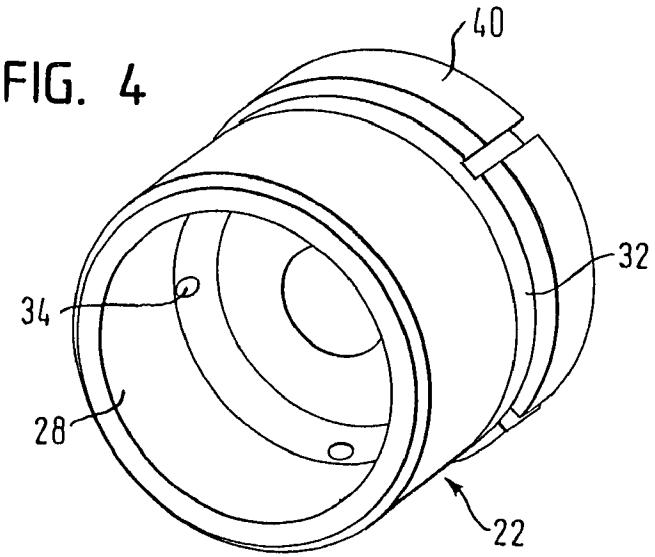
FIG. 4 shows an end piece which is used in the piston shown in FIG. 3 in a perspective view.

As can be seen in FIG. 4, the body of the end piece 22 can be provided with a flange region 40, which due to corresponding tolerances has the function of a guide ring. This allows to do with only one piston ring 24. Alternatively, it is, however, also possible to additionally use special guide rings.

Figure 3:
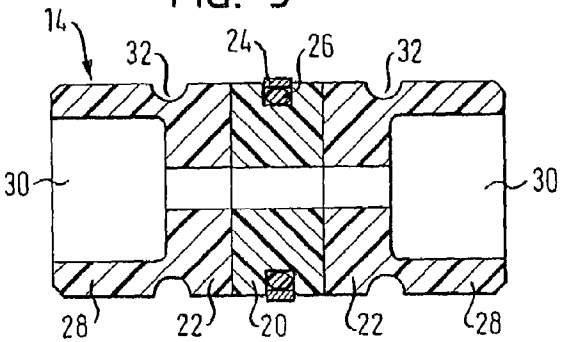
FIG. 3 shows a piston in accordance with a first embodiment in a sectional view.
Figure 5:
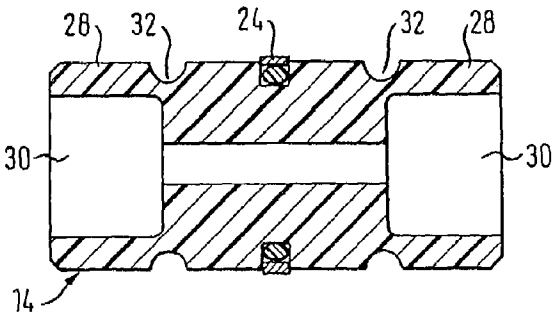
FIG. 5 shows a piston in accordance with a second embodiment in a sectional view.
Figure 2:
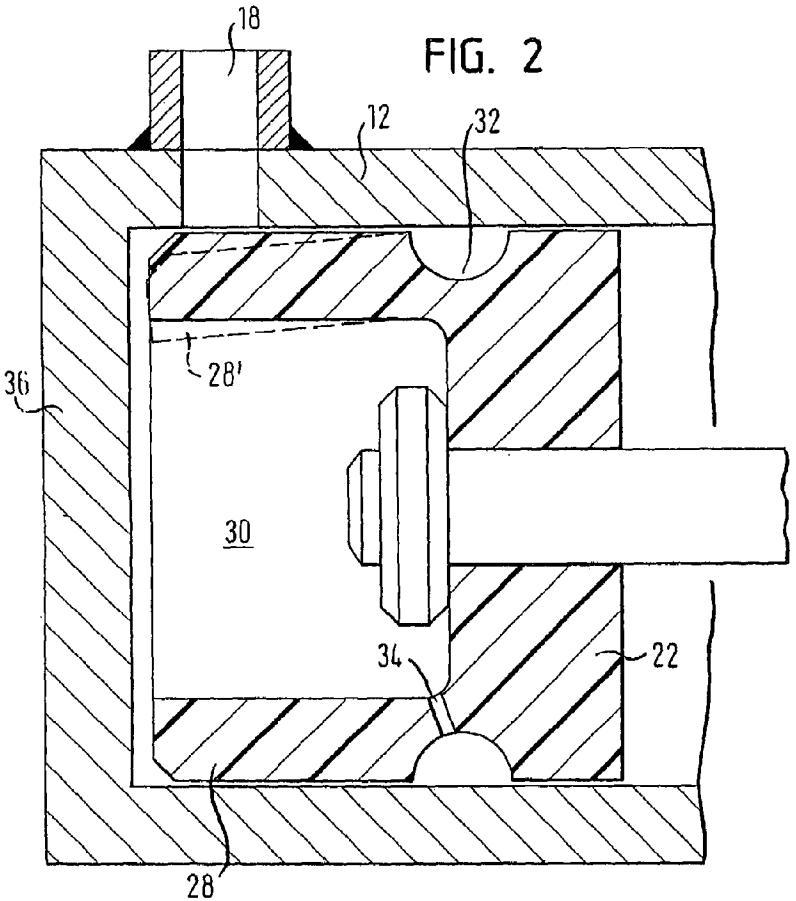
FIG. 2 shows a schematic diagram on an enlarged scale.

Instead of the three-part design of the piston, as it is shown in FIGS. 2 to 4, there can also be used a one-piece piston, as it is shown in FIG. 5.

Figure 6:
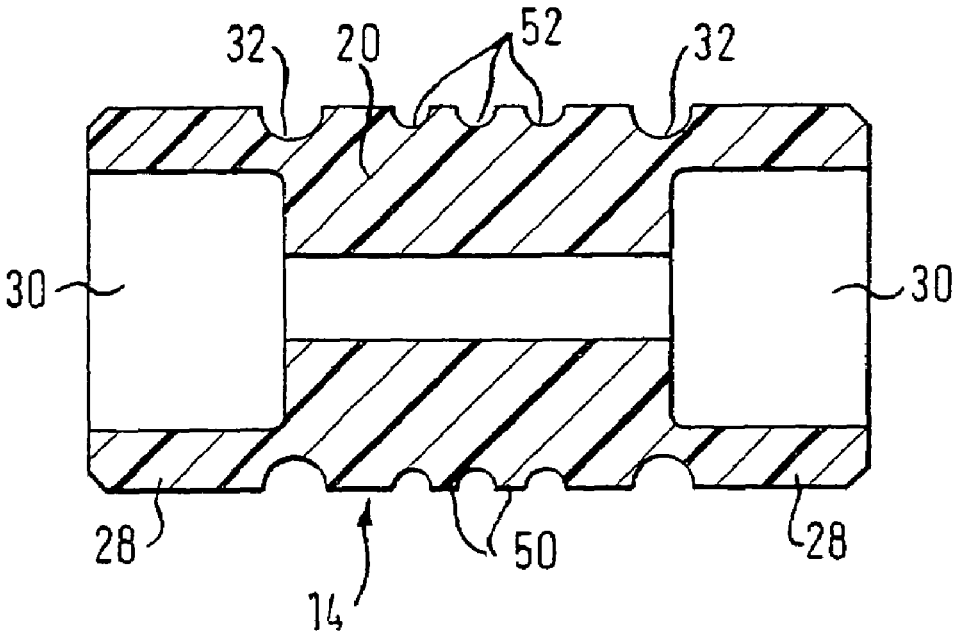
FIG. 6 shows a piston in accordance with a third embodiment in a sectional view.

FIG. 6 shows a piston in accordance with a third embodiment. Here, the piston likewise has a one-piece design. In contrast to the second embodiment, a piston ring is not necessary here; the piston is provided with a plurality of sealing ribs 50 with interposed grooves 52, by means of which a sufficient sealing at the wall of the cylinder 12 is achieved.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A hydraulic cylinder comprising:

a cylinder;

a piston which is adjustable in the cylinder; and at least one pressure connection which is disposed in the vicinity of an end position of the piston and through which a pressure fluid can be introduced into the cylinder;

wherein the piston is provided with an elastically deformable part forming a valve element which cooperates with the pressure connection, in order to cover the pressure connection when the piston approaches its end position, and in order to uncover the pressure connection when pressure fluid is introduced into the cylinder, such that when pressure fluid is introduced into the cylinder, the elastically deformable part of the valve element is deformed radially inwardly and away from the at least one pressure connection, thereby creating an enlarged flow path for incoming pressure fluid between an inner wall of the cylinder and the deformed part of the valve element.

2. The hydraulic cylinder as claimed in claim 1, wherein the elastically deformable part forming the valve element is an apron.

3. The hydraulic cylinder as claimed in claim 2, wherein the apron is integrally formed with the piston.

4. The hydraulic cylinder as claimed in claim 2, wherein the piston has a multi-part design and has a pot-like end piece, which is provided with the apron.

5. The hydraulic cylinder as claimed in claim 1, wherein the piston is provided with an annular groove, which by means of a passage is connected with that side of the piston to which the pressure fluid is applied.

6. The hydraulic cylinder as claimed in claim 1, wherein the piston is provided with a piston ring.

7. The hydraulic cylinder as claimed in claim 1, wherein the piston is provided with at least one sealing rib integrally formed with the same.

8. The hydraulic cylinder as claimed in claim 1, wherein a limit stop is provided, which prevents the valve element from resting against an end face of the cylinder when the piston is in its end position.

* * * * *